US005714962A

United States Patent [19]

Josefsson

[11] Patent Number: 5,714,962

[45] Date of Patent: Feb. 3, 1998

[54] ARRAY ANTENNA

[75] Inventor: Lars Gustaf Josefsson, Askim, Sweden

[73] Assignee: Telefonaktiebolaget LM Ericsson, Stockholm, Sweden

[21] Appl. No.: 853,565

[22] Filed: May 9, 1997

Related U.S. Application Data

[63] Continuation of Ser. No. 593,173, Feb. 1, 1996, abandoned, which is a continuation of Ser. No. 300,212, Sep. 6, 1994, abandoned.

[30] Foreign Application Priority Data

Sep. 6, 1993 [SE] Sweden ..... 9302863

[51] Int. Cl.[6] ..... H01Q 13/10

[52] U.S. Cl. ..... 343/771; 343/770; 343/841

[58] Field of Search ..... 343/767, 770, 343/771, 776, 841, 762, 851

[56] References Cited

U.S. PATENT DOCUMENTS

| | | | |
|---|---|---|---|
| 2,349,942 | 5/1944 | Dällenbach | 343/771 X |
| 2,455,403 | 12/1948 | Brown | 343/841 X |
| 2,589,433 | 3/1952 | Riblet | 343/771 X |
| 2,659,005 | 11/1953 | Gruenberg | 343/771 X |
| 2,881,436 | 4/1959 | Stavis | 343/771 X |
| 3,523,297 | 8/1970 | Fee | 343/771 X |
| 3,594,806 | 7/1971 | Black et al. | 343/771 |
| 3,599,215 | 8/1971 | Yoshida et al. | 343/767 |
| 3,860,933 | 1/1975 | Terakawa et al. | 343/771 |
| 4,499,474 | 2/1985 | Muhs, Jr. et al. | 343/771 |
| 4,912,482 | 3/1990 | Woloszczuk | 343/841 |
| 5,172,127 | 12/1992 | Josefsson | 343/771 |
| 5,270,723 | 12/1993 | Lopez et al. | 343/771 X |

FOREIGN PATENT DOCUMENTS

| | | | |
|---|---|---|---|
| 2 390 027 | 1/1978 | France | 343/771 |
| 469540 | 11/1991 | Sweden . | |

*Primary Examiner*—Hoanganh T. Le
*Assistant Examiner*—Tho Phan
*Attorney, Agent, or Firm*—Burns, Doane, Swecker & Mathis, L.L.P.

[57] ABSTRACT

Array antenna has a number of radiating elements and is provided with an arrangement to reduce the reflection of the incident radiation in a direction opposite to that of the incident radiation. The arrangement includes electrically conducting elements which are located between the radiating elements and substantially parallel to the electrical field of the radiating elements.

6 Claims, 1 Drawing Sheet

ARRAY ANTENNA

This application is a continuation of application Ser. No. 08/593,173, filed Feb. 1, 1996, abandoned, which was a continuation of application Ser. No. 08/300,212, filed Sep. 6, 1994, abandoned.

BACKGROUND

The present invention relates to an array antenna according to the preamble of claim 1.

Nowadays, array antennas are used to a great extent as antennas for radio links, radar stations and in other connections when it is desired to direct the transmitted radiation energy in a certain direction. These array antennas are built from a number of radiating elements which, by interaction, provide the antenna with the desired properties. By way of example, an array antenna can be composed of a number of waveguide slot antennas, that is antennas which consist of waveguides provided with slots in one of the waveguide walls. The slots act as radiating elements and are normally located along the longitudinal direction of the waveguide and at a mutual distance approximately equal to one or one half waveguide wavelength. In the latter case, the slots are often alternately displaced with respect to the centre line of the waveguide.

An array antenna composed of several waveguides will constitute a large, plane surface. If such an antenna is illuminated with radiation from another antenna, the incident radiation will be reflected. Normally the radiation is reflected away from the illuminating antenna and is then unimportant, but under certain conditions a heavy re-radiation (in the following named reflexion) may appear in a direction which is opposite to that of the incident radiation. This occurs of course when the radiation incides perpendicular to the antenna surface, as well as in certain other directions.

Reflection may primarily occur when the frequency of the incident radiation is within the same frequency range as that for which the array antenna is intended. When the direction of the incident radiation is such that its electrical field vector is primarily located in the same plane as the electrical field vector of the radiating elements (the slots), the radiating elements will be excited and thereby emit radiation. When the phase difference between the radiation from two slots corresponds to one full wavelength, the radiation is merged and a plane wave front is generated which propagates in a specific direction.

It can be shown, that for the most commonly existing dimensions of the waveguides and at a direction of incidence of approximately 45° from the main direction of the antenna, a wave front which propagates in the opposite direction will be generated. Thus, the radiation will be reflected back towards the source of radiation. In certain applications this is not wanted, one of several reasons being that interference phenomena may arise. In connection with radar, it is disadvantageous if a passive (not transmitting) antenna were to give a strong reflection and thereby reveal its position.

The object of the present invention is therefore to reduce these unwanted reflections and in that way to reduce the risks for interference and radar detection.

SUMMARY

Said object is achieved by an array antenna according to the present invention, in which the antenna comprises a plurality of radiating elements and an arrangement for reducing reflection of incident radiation. The arrangement comprises electrically conducting elements disposed between the radiating elements and substantially parallel to the electric field of the radiating elements.

DETAILED DESCRIPTION

In order to facilitate the understanding of the invention and by way of introduction, the generation of re-radiation/reflections from a waveguide slot antenna will be described.

Figure 1:
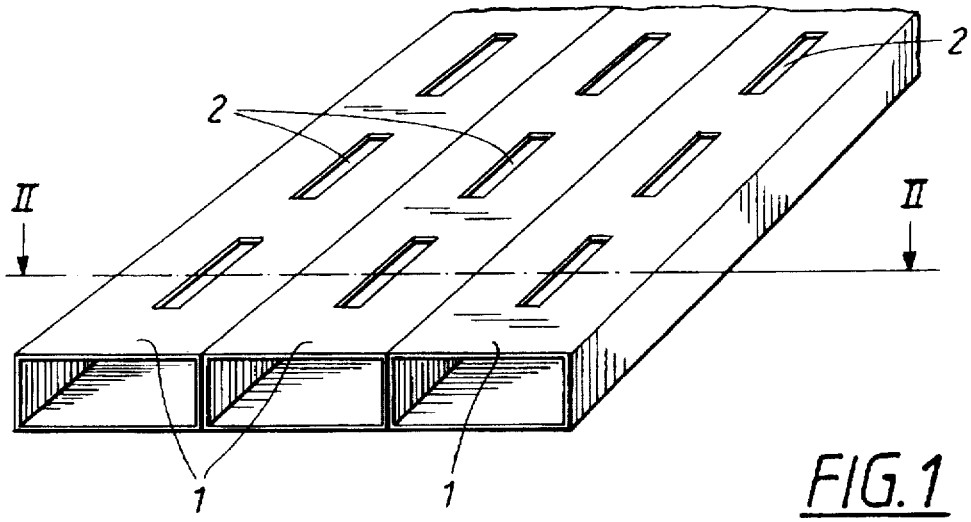
FIG. 1 shows a part of an array antenna composed of wave-guide slot antennas.

FIG. 1 shows a part of such an antenna. The antenna consists of a number of waveguides 1 placed adjacent to each other. In each waveguide, radiation elements in the form of slots 2 are arranged. The longitudinal direction of the slots are in principle parallel to the longitudinal direction of the waveguides.

Figure 2:
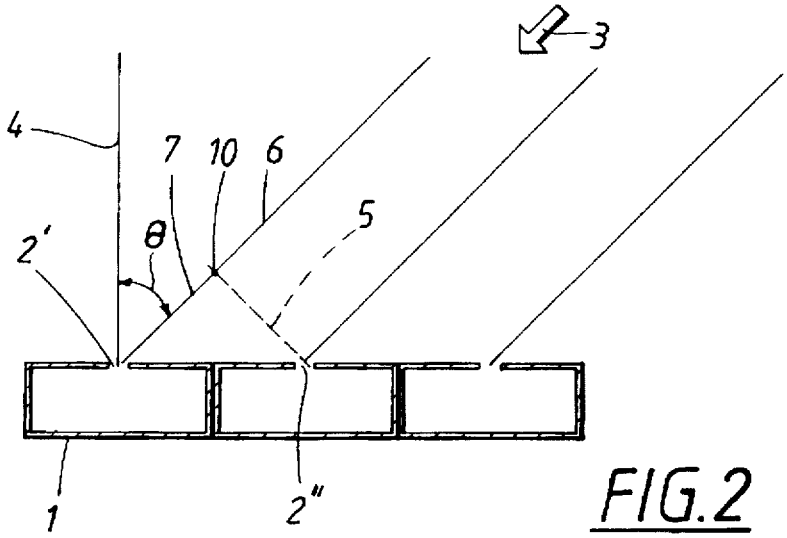
FIG. 2 shows a section through the antenna of FIG. 1.

FIG. 2 shows a section through the antenna along the line II—II in FIG. 1. Radiation 3, for example a plane wave front, incides from the side along line 6 against the waveguides 1. The line 6 forms an angle Θ to the normal 4 of the antenna surface. The plane wave front reaches the slots 2 and excites them. The slots will thereby emit radiation in various directions.

In FIG. 2, the reference number 5 denotes a broken line which is perpendicular to the line 6 and which passes through a slot 2". The distance along line 6 between the crossing point 10 of the lines and a slot 2', through which the line 6 passes, is denoted 7.

It is known that the width of a waveguide normally is of the order of $0.7\cdot\lambda_0$, where $\lambda_0$ denotes the wavelength in free space. The distance between the slots in two adjacent waveguides will therefore be about $0.7\cdot\lambda_0$.

It is further known that when the phase difference between the radiation from a number of radiation sources corresponds to a number of full wavelengths, a plane wave front is generated. If therefore the phase shift for a wave, which incides along the line 6, between the crossing point 10 and the slot 2' and back to the crossing point is equal to $\lambda_0$, it will interact with the re-radiation from the slot 2". This means that when the distance 7 is equal to $\lambda_0/2$, a wave front will propagate along line 6, away from the antenna. This occurs when $$\lambda_0/2=0.7\cdot\lambda_0\cdot\sin\Theta \qquad \text{(A)}$$

that is for $\Theta\approx45°$. If the antenna is illuminated from this direction, the radiation will thus be reflected back in the opposite direction.

In an array antenna composed of a large number of waveguide slot antennas, the radiation from the slots will interact with a heavy reflex, or large retroreflection, as a consequence.

Figure 3:
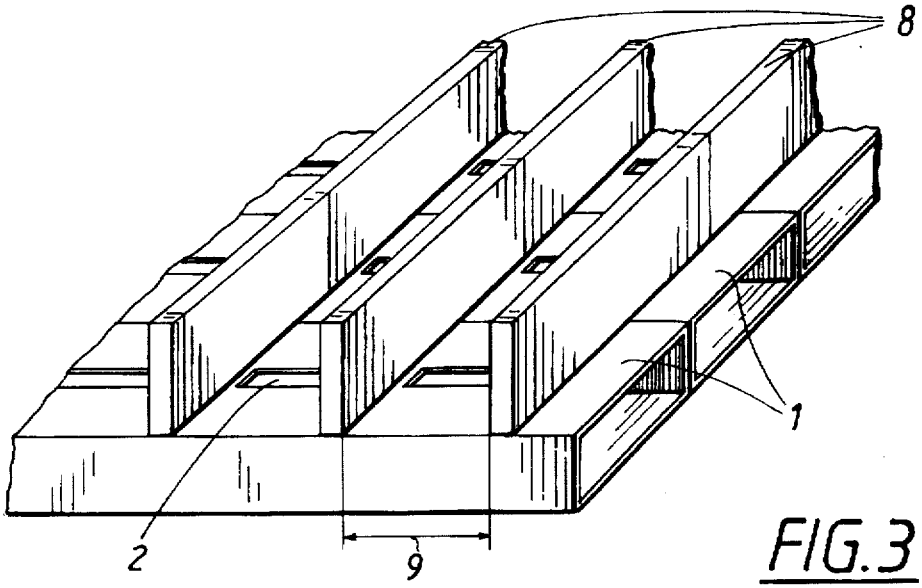
FIG. 3 shows a preferred embodiment of the invention.

FIG. 3 shows a preferred embodiment of the invention. Parallel, electrically conducting elements 8, for example metal sheets, have been placed between the slots 2 across the longitudinal direction of the waveguides and of the slots, that is mainly parallel to the electrical field vector of the radiating elements. By choosing various sheet thicknesses, the distance 9 between the facing surfaces of two sheets can be changed.

When a plane wave, coming from the outside and with a direction of incidence which is parallel to the metal sheets 8 and which forms the angle $\Theta$ against the normal 4, is propagating between the metal sheets, its wavelength will be changed. The space between the metal sheets will namely act as a waveguide, the wavelength of which is defined by the distance 9. In the following, this wavelength is denoted $\lambda_1$.

In analogy with the earlier derived expression (A) the following expression for the wave propagation between the metal sheets 8 may be written for the case when the slots interact:

$$\lambda_1/2=0.7\cdot\lambda_0\cdot sin\theta_1 \quad \text{(B)}$$

in which $\Theta_1$ is the direction of the incident wave with respect to the normal 4 between the metal sheets 8.

It is known that when a wave passes from one media into another media its velocity (phase velocity) will be changed which means that the direction of propagation of the wave is changed. Applied to the now discussed case when a wave from "free space" passes into a waveguide formed by the metal sheets 8, because the phase velocity in the medias are proportional to the respective wavelengths, the following expression can therefore be written:

$$\lambda_1\cdot sin\theta=\lambda_0 sin\theta_1 \quad \text{(C)}$$

in which, according to the above, $\Theta$ thus indicates the direction of propagation for the wave in "free space" and $\Theta_1$ the corresponding direction between the sheets 8.

If the expressions (B) and (C) are combined, it will be found that the slots interact for $\sin\Theta=(2\cdot0.7)^{-1}$ also in the case with metal sheets, that is for the same $\Theta$ as in the case without metal sheets.

At the limit case $\Theta_1=90°$ ($\sin\Theta_1=1$), the incident wave will not force its way in between the sheets, but will propagate along the edges of the sheets. With the aid of the expression (C), it can be seen that this occurs for $$\theta=\arcsin(\lambda_0/\lambda_1) \quad \text{(D)}.$$

When $\Theta$ is greater than the limit case angle, the main part of the incident wave will be reflected away from the direction of incidence, namely in a direction $2\cdot\Theta$ from the direction of incidence (mirroring), whilst only a minor part of the field of the wave propagates between the sheets and reaches the slots.

As has been shown, reflections from a waveguide slot antenna may appear at an angle of incidence>45,° whether it be provided with metal sheets 8 or not. With the aid of the expression (D), a value of $\lambda_1$ can be derived which implies that the limit case occurs at, for example, $\Theta=40°$. This implies that at angles of incidence>40°, the main part of the incident wave will be reflected away, whilst only a minor part of the radiation reaches the slots. These will therefore be excited only to a minor extent, which results in a large reduction of the reflection.

With the calculated value for $\lambda_1$ as a starting point, the corresponding distance 9 between the sheets 8 can be calculated by means of expressions and methods known to a person skilled in the art.

The height of the sheets above the waveguide surface affects the magnitude of the field which reaches the slots. Practical tests show that a lower limit for the height 20 is about $0.5\cdot\lambda_0$. At this height a suppression of the reflections in the order of 20 dB is achieved. Higher sheets will further improve the suppression. The upper limit for the height of the sheets is, however, primarily defined by the antenna dimensions which can be allowed. From the suppression point of view, it does not matter if the sheets have electrical contact with the waveguide surface or not.

By choosing a suitable sheet thickness and height, it is thus possible, according to the invention, to provide an array antenna in which the unwanted reflections are reduced.

In the exemplified embodiment, the invention has been applied to an array antenna consisting of waveguide slot antennas. However, the arrangement can advantageously also be used for other types of antenna in which the radiation from several elements are merged. The radiating elements can thus consist of dipoles, stripline slots etc.

The invention is not limited to the above described embodiments but can be varied within the scope of the appended claims.

What is claimed is:

1. An array antenna comprising:

at least one waveguide;

a plurality of radiating elements on said at least one waveguide whose lengths are arranged substantially parallel to a longitudinal direction of said waveguide;

and means for reducing reflection of incident radiation in a direction opposite to a direction of propagation of the incident radiation, wherein the reducing means comprises electrically conducting elements located between the radiating elements on the at least one waveguide, arranged substantially perpendicular to said longitudinal direction of said waveguide, and substantially parallel to an electrical field generated by the radiating elements.

2. The array antenna of claim 1, wherein a distance between surfaces of two successive electrically conducting elements is chosen so that propagation of the incident radiation between the two successive electrically conducting elements is substantially prevented for directions of propagation which generate reflections in directions opposite to the directions of propagation.

3. The array antenna of claim 2, wherein the radiating elements are waveguide slots.

4. The array antenna of claim 2, wherein the electrically conducting elements have heights that are greater than half a wavelength of the incident radiation in free space.

5. The array antenna of claim 1, wherein the radiating elements are waveguide slots.

6. The array antenna of claim 1, wherein the electrically conducting elements have heights that are greater than half a wavelength of the incident radiation in free space.

* * * * *

UNITED STATES PATENT AND TRADEMARK OFFICE

CERTIFICATE OF CORRECTION

PATENT NO. : 5,714,962

DATED : February 3, 1998

INVENTOR(S) : Lars Gustaf Josefsson

It is certified that error appears in the above-identified patent and that said Letters Patent is hereby corrected as shown below:

Column 3, line 49, delete "〉" and insert therefor --≈--.

Signed and Sealed this

Second Day of March, 1999

*Attest:*

*Attesting Officer*

Q. TODD DICKINSON

*Acting Commissioner of Patents and Trademarks*